US006000950A

United States Patent [19]

Kajinuma

[11] Patent Number: 6,000,950

[45] Date of Patent: Dec. 14, 1999

[54] CONNECTOR FOR FLEXIBLE PRINTED CARDS

[75] Inventor: Shuji Kajinuma, Yamato, Japan

[73] Assignee: The Whitaker Corporation, Wilmington, Del.

[21] Appl. No.: 08/992,155

[22] Filed: Dec. 17, 1997

[30] Foreign Application Priority Data

Dec. 27, 1996 [JP] Japan ..... 8-358208

[51] Int. Cl.[6] ..... H01R 9/09

[52] U.S. Cl. ..... 439/60; 439/496

[58] Field of Search ..... 439/60, 59, 496

[56] References Cited

U.S. PATENT DOCUMENTS 4,613,193 9/1986 Beers ..... 439/59
4,869,672 9/1989 Andrews, Jr. ..... 439/60
4,934,961 6/1990 Piorunneck et al. ..... 439/59
5,052,936 10/1991 Biechler et al. ..... 439/60
5,848,920 12/1998 Klein et al. ..... 439/60

FOREIGN PATENT DOCUMENTS 10-189175 7/1998 Japan ..... H01R 23/68

*Primary Examiner*—Renee S. Luebke
*Assistant Examiner*—Hae Moon Hyeon

[57] ABSTRACT

FPC connector (20) has multiple beam-shaped primary contacts (50) arranged on one side of an opening (30*a*) in housing (30) and multiple U-shaped secondary contacts (60) arranged along the other side of the opening. A tongue (45) of outer housing (40) together with the contact edge of the FPC (10) is inserted in the U-shaped portions of these U-shaped secondary contacts (60). This results in the forming of electrical contact between contact points (65, 53) of the contacts (60) and the primary contacts (50) with the conductive pads (12, 13) arranged in two rows along the contacting edge of the FPC (10).

9 Claims, 5 Drawing Sheets

CONNECTOR FOR FLEXIBLE PRINTED CARDS

FIELD OF THE INVENTION

This invention relates to electrical connectors for flexible printed cards or circuits (FPC connectors), especially to FPC connectors intended for contacts with conductive pads made on high density flexible printed cards.

BACKGROUND OF THE INVENTION

Flexible printed cards are finding numerous practical applications ever since it became possible to form multiple parallel conductive pads on one surface or both surfaces of thin flexible insulating cards, for example, by etching.

Compared to individual conductors, flexible printed cards have substantial advantages in connecting components of complicated configurations or units moving relative to each other during operation due to such features as their flexibility, ability to pack a large number of conductive pads on a small area and their thinness.

FPC connectors are used to connect FPCs to conducting pads of circuit boards. FPCs and FPC connectors are finding wide use in consumer electronics and office equipment. In consumer electronics, FPCs are used to apply control signals to such devices as liquid-crystal, plasma and electroluminecence (EL) displays which require an extraordinary large number of conductors. They are also used in high-performance electronic equipment, such as microprocessors, to connect transistor components for the transmission of large volumes of data and control signals. FPCs used for these purposes feature a high density of conductors (up to 0.3 mm pitch) and they are commercially available.

Description of design of conventional FPC connectors can be found, for example, in Japanese Utility Model Disclosure No. 3-22869. In this conventional FPC connector, electrical contacts having contact sections in the form of a tuning fork are arranged along a housing opening. A connecting end of an FPC is inserted in the tuning-fork contact sections along with an insulating slider. An electrical connection is made by conductive pads at the FPC connecting end being engaged by contact points of the electrical contacts.

The optimum density for such conventional FPC connectors is of the order of 1 mm pitch between conductive pads, and they can be used with FPCs whose pitch is below 0.5 mm only with considerable difficulties.

In addition, attempts to reduce dimensions of the FPC connector itself result in the compromising of contact springability, thus reducing the reliability of electrical connection.

SUMMARY OF THE INVENTION

Therefore, the purpose of the present invention is to offer small size FPC connectors suitable for electrical connection with high density FPCs which will make it possible to produce reliable electrical connections.

This invention represents a connector for flexible printed cards having multiple contacts arranged in a housing whose purpose is to form electrical connection with conductive terminal pads arranged in two rows which are connected to multiple conductive paths arrayed in a roughly parallel pattern on one side of a flexible printed card.

Two types of electrical contacts are used in the connector: multiple primary beam-shaped contacts arranged along one side of the housing which have contact points near the free end of the beam, and multiple secondary U-shaped contacts arranged along the other side of the housing which have the contact point near the free end of the U-shaped bent portion of the contacts. The contact points of the primary and secondary contacts electrically connect with different rows of conductive pads on the flexible printed card. In other words, the contacts form an effective connection with the flexible printed card due to the fact that there are two types of contacts, i.e., beam-shaped and U-shaped contacts arranged inside the housing in different rows.

The other connector for flexible printed cards according to the present invention has multiple contacts arranged in the housing which are designed to form connection with conductive pads connected to multiple conductive circuits arrayed in a roughly parallel pattern on one side of a flexible printed card the contacts are arranged inside the housing and have U-shaped portions at whose free ends contacting points are located. The connection between the conductive pads and the contact points is formed by the insertion of the edge of the flexible printed card and a movable tongue in the U-shaped portions of the contacts.

BRIEF DESCRIPTION OF THE DRAWINGS

Embodiments of the invention will now be described by way of example with reference to the accompanying drawings in which.

DETAILED DESCRIPTION OF THE INVENTION

Figure 1A:
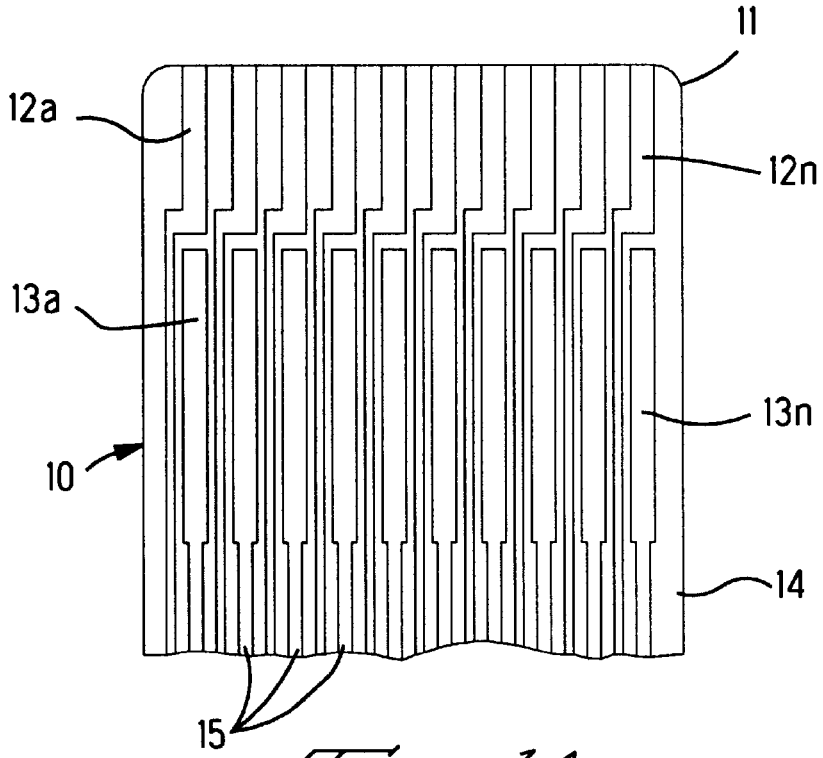
FIGS. 1A and 1B are plan views of flexible printed cards used in conjunction with an FPC connector according to the present invention with FIG. 1A showing an FPC having an in-line pattern of conductive pads and FIG. 1B showing an FPC having a staggered pattern of conductive pads.
Figure 1B:
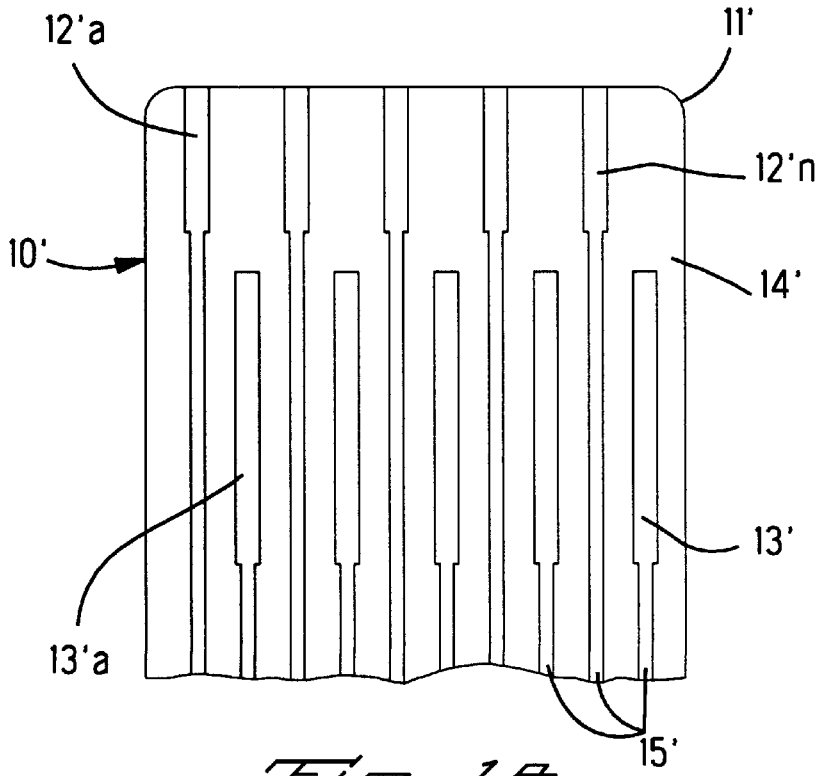

FIGS. 1A and 1B show the edge of a flexible printed card or circuit to be connected to an FPC connector. At the edge of the FPC, two rows of conductive pads are disposed. FPC 10, shown in FIG. 1A, has a first row of conductive pads 12*a*–12*n* arranged along edge 11 and a second row of conductive pads 13*a*–13*n* a certain distance from edge 11 on a flexible insulating film 14. All conductive pads 12 and 13 are connected to their individual conductors or circuit paths 15 which are arrayed in an alternate parallel pattern and at equal distances from each other. In this case, the conductive pads 12*a*–12*n* of the first row and the conductive pads 13*a*–13*n* of the second row are arranged in one line; that is, FPC 10 is of the in-line type with respect to the arrangement of the conductive pads.

FIG. 1B shows FPC 10' of a different type. The difference of this card from that shown in FIG. 1A is that the conductive pads 12'a–12'n of the first row and the conductive pads 13'a–13'n of the second row are arranged in an offset staggered pattern rather than according to the in-line pattern. Otherwise, the FPC 10' is similar to the FPC 10 and all equivalent elements are denoted by the same reference numbers.

The first embodiment of the FPC connector 20 with reference to FIGS. 2A and 2B will now be described. The FPC connector 20 is for use with the FPC 10 shown in FIG. 1A. FPC connector 20 comprises an inner housing 30 having an opening located in the middle, an outer housing 40 fitting over the inner housing 30 in a detachable manner and having a slot 41 for receipt of the FPC 10 in its center, primary contacts 50 and secondary contacts 60 arranged along opposing inside walls 31 of the opening 30*a* of the inner housing 30.

Multiple primary contacts 50 are in the form of a beam or cantilever and are vertically arranged along a first inside wall 31 of the inner housing 30. Primary contacts 50 have soldering tails 51 intended for SMT mounting extending to the outside of the housing through the bottom of the inner housing 30, retaining sections 52 located on the beam in the form of barbs secure the contacts in the housing by biting in the partitions (not shown) of the housing 30, and free ends 54 and contact points 53 that bend in the direction away from the opposing wall 31 in alignment. In addition, as can be seen from FIG. 2B, the free ends 54 of the primary contacts 50 are inserted in openings 33 located in the upper portion of the inner housing 30 to prevent the contacts from deformation under an excessive load.

Along inside wall 31 of opening 30*a* of the inner housing multiple secondary contacts 60 are arranged at a predetermined pitch so that they are in the same planes as the primary contacts 50. These secondary contacts 60 have SMT soldering tails 61, barbed retaining sections 62, riser sections 63 extending along the inside wall 31, U-shaped sections 64 formed by bending inner ends of the riser sections 63, and contact points 65 near the free ends 66 of the U-shaped sections 64. Thus, the configuration of the secondary contacts 60 is a U-shape.

Figure 2A:
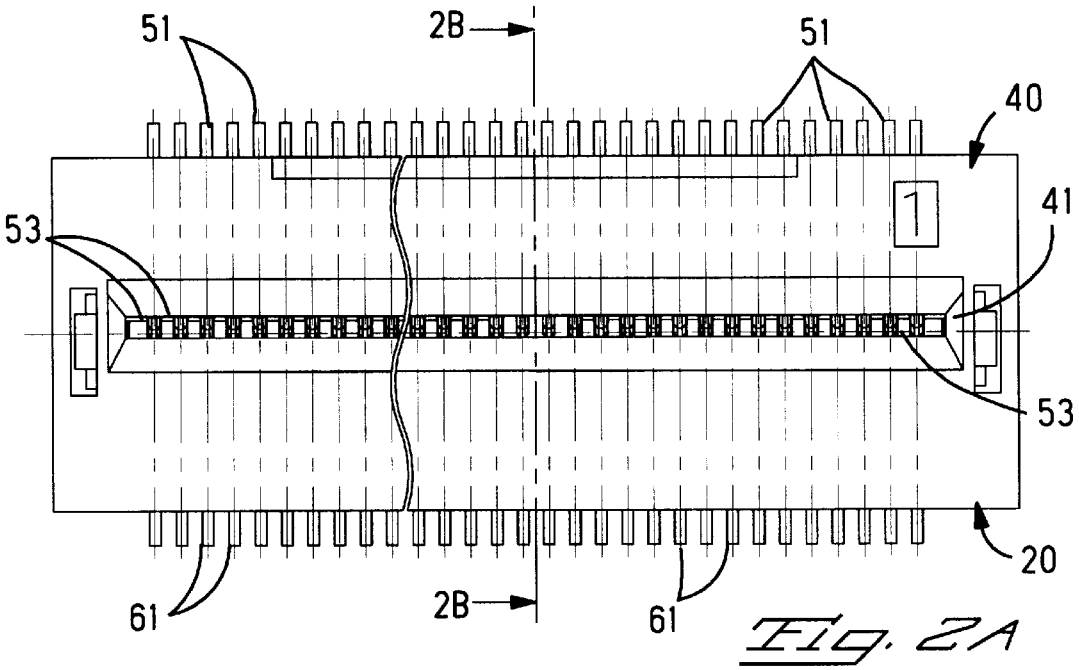
FIG. 2A is a top plan view of a first embodiment of an FPC connector according to the present invention.
Figure 2B:
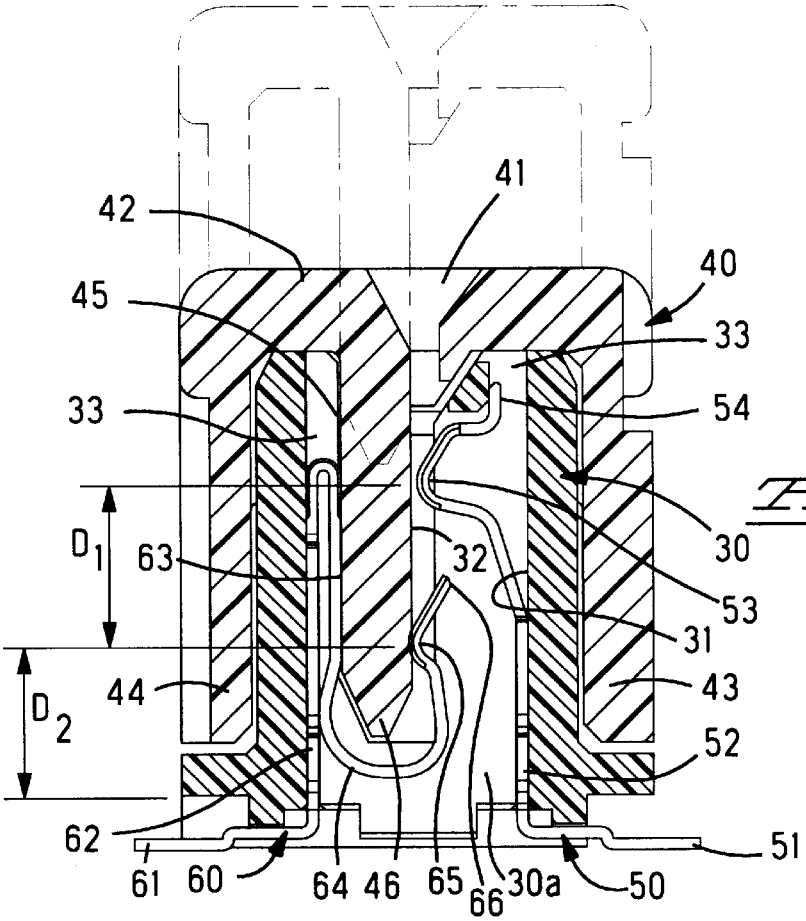
FIG. 2B is a cross-sectional view taken along line 2B—2B of FIG. 2A.

The outer housing 40 can move up and down between two positions, one of which (the final position) is shown in FIG. 2B by solid lines, and the other one (temporary, at the time of insertion of the connection edge 11 of the FPC 10) is shown by broken lines. The outer housing 40 has an upper section 42 with slot 41 with tapered edges made for the insertion of the FPC 10, side walls 43, 44, and a tongue 45 which is inserted in the opening 30*a* of the inner housing 30. The front end 46 of this tongue 45 extends to the lowest point of the outer housing 40 and reaches the bottom of the U-shaped sections 64 of the secondary contacts 60.

Contact points 53 of the primary contacts 50 and contact points 65 of the secondary contacts 60 are located in such a way that they make electrical contact respectively with conductive pads 13*a*–13*n* of the second row and conductive pads 12*a*–12*n* of the first row of the FPC 10. Distance D1 between both contact points 53, 65 and the distance D2 shown in FIG. 2B are determined by positions of conductive pads 12, 13 of the FPC 10.

Assuming that, as one can see from FIG. 2B, the range of the effective spring-loaded deformation of the primary contacts 50 is of the order of 4 mm, the primary contacts 50 possess effective spring force. However, since the secondary contacts 60 are located close to the bottom of the housing 30, that is to the mounting surface, it is impossible to provide sufficient spring force to the contacts if it has a beam configuration. Therefore, as has been described above, the secondary contacts 60 are made in the U-shape configuration, thus providing for a greater effective length of the spring-loaded portion and therefore sufficient spring force. In addition, due to the fact that the contact edge of the FPC 10 is inserted in the U-shaped sections 64 of the secondary contacts 60 together with the tongue 45 of the outer housing 40, the reliability of the connection between the conductive pads 12 of the first row of the FPC 10 and the contact points 65 is substantially improved.

Next, the second embodiment of the FPC connector according to this invention with reference to FIGS. 3A through 3C will be described. FPC connector 20' is intended for the use with the FPC 10' shown in FIG. 1B. It is very much similar to FPC connector 20, therefore mostly the differences between these two connectors will be explained.

As has been described above, FPC 10' shown in FIG. 1B has conductive pads 12', 13' arranged in an offset staggered pattern. Therefore, the primary contacts 50' and secondary contacts 60' also must be arranged in a staggered pattern. Therefore, in FIG. 3B, it can be seen that all of primary contact 50' is shown, but only a portion of the contact point 65' of the secondary contact 60'. On the other hand, in the FIG. 3C, the entire secondary contact 60' and only a portion of the contact point 53' of the primary contact 50' can be seen.

Figure 3A:
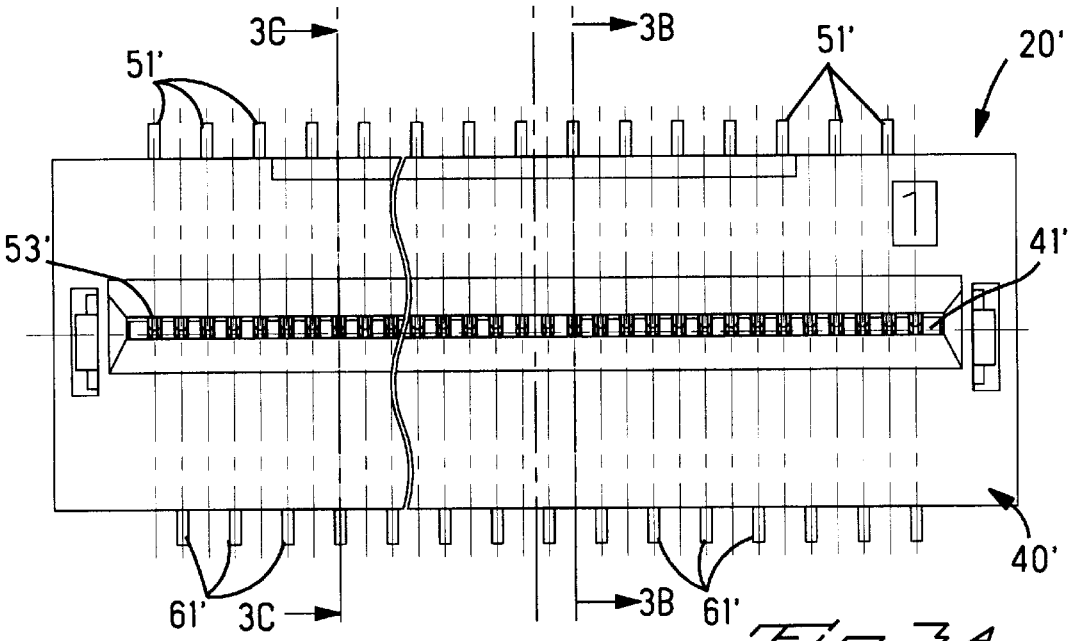
FIG. 3A is a top plan view of a second embodiment of the FPC connector according to the present invention.
Figure 3B:
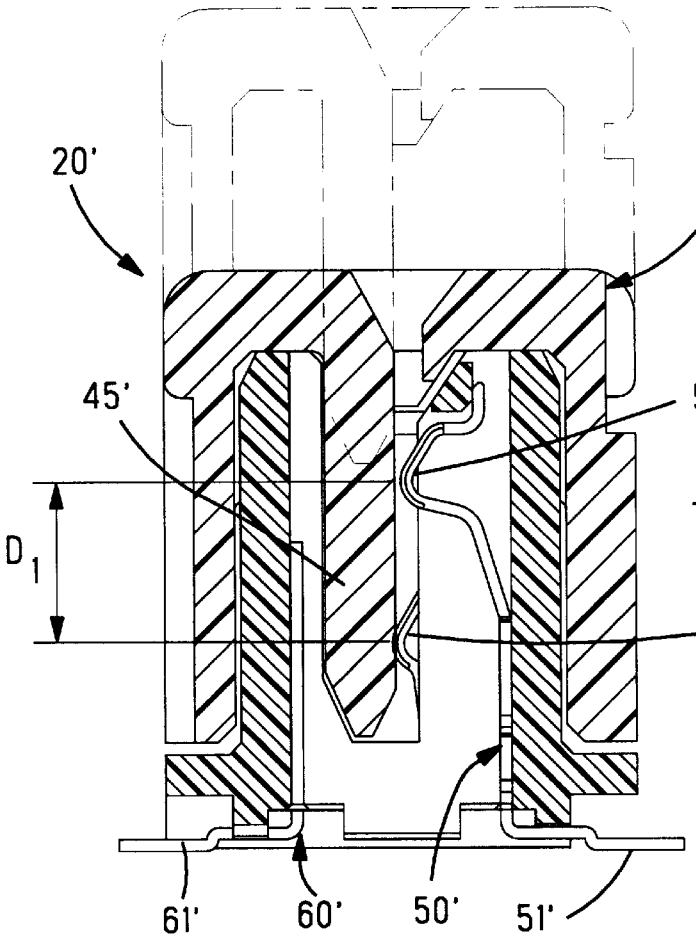
FIGS. 3B and 3C are cross-sectional views taken along lines 3B—3B and 3C—3C of FIG. 3A.
Figure 3C:
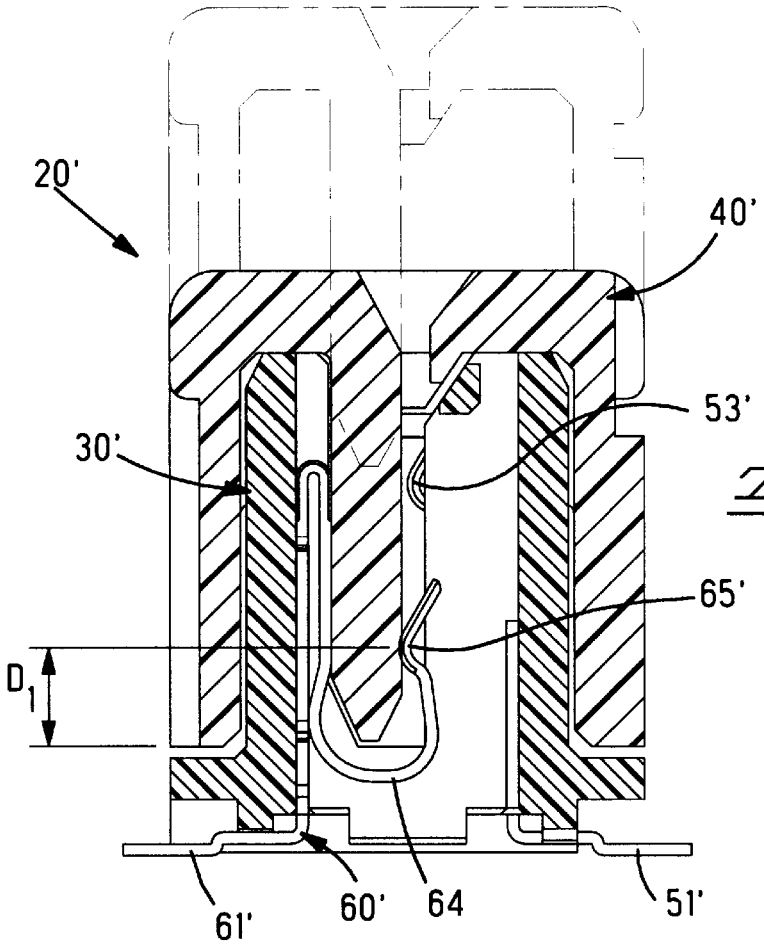

Since FIGS. 2A and 2B and FIGS. 3A–3C are similar to each other, all explanations regarding construction and operation of the FPC connector 20 shown in FIGS. 2A and 2B are applicable to the FPC connector 20' shown in FIGS. 3A–C.

Figure 4A:
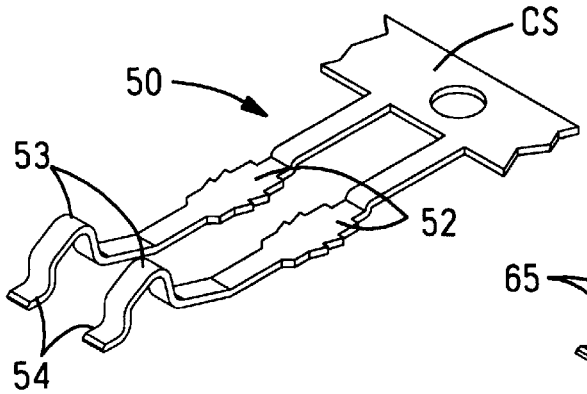
FIGS. 4A and 4B are perspective views of beam-shaped primary contacts and U-shaped secondary contacts used in the FPC connectors according to this invention.
Figure 4B:
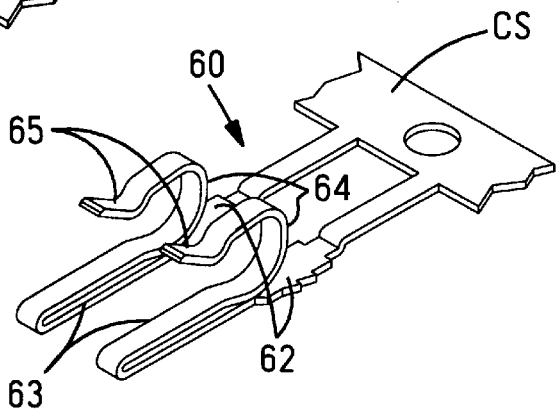

It is evident that contacts 50, 60 shown in FIGS. 4A and 4B can be manufactured by stamping from metal sheet material with subsequent forming to a required configuration using conventional technology and conventional equipment. The contacts are shown together with their carrier strips which are removed at the time of assembly using a standard technique.

Figure 5:
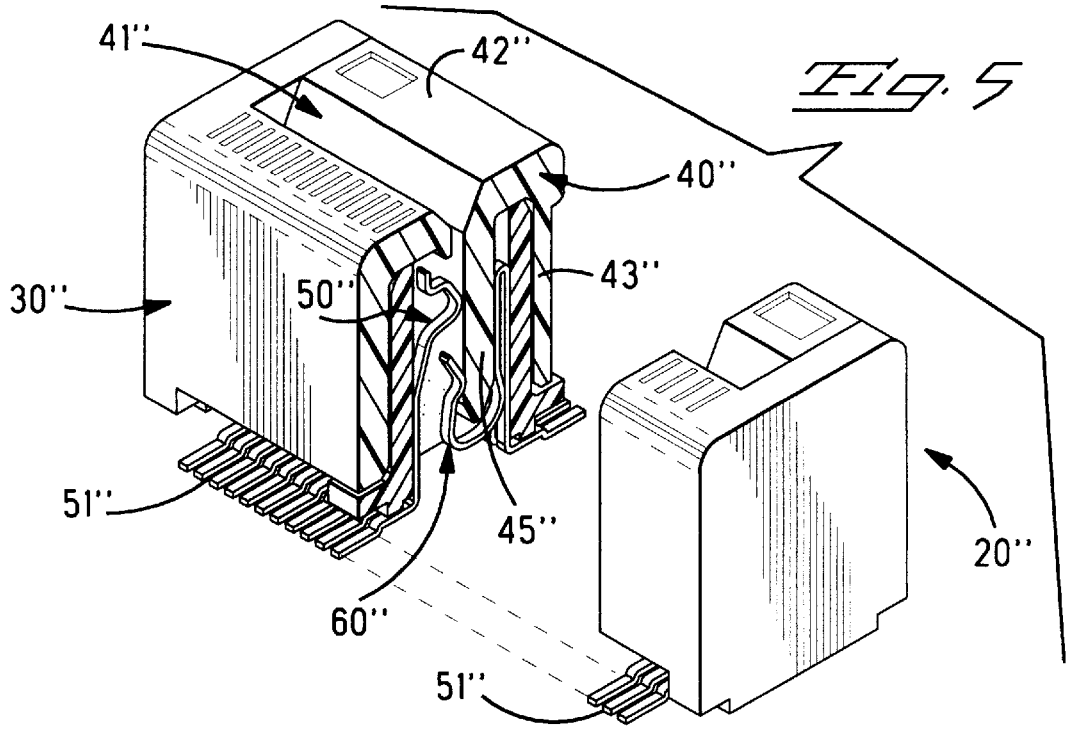
FIG. 5 is a perspective view with a cut-out section of a third embodiment of the FPC connector according to this invention.
Figure 6:
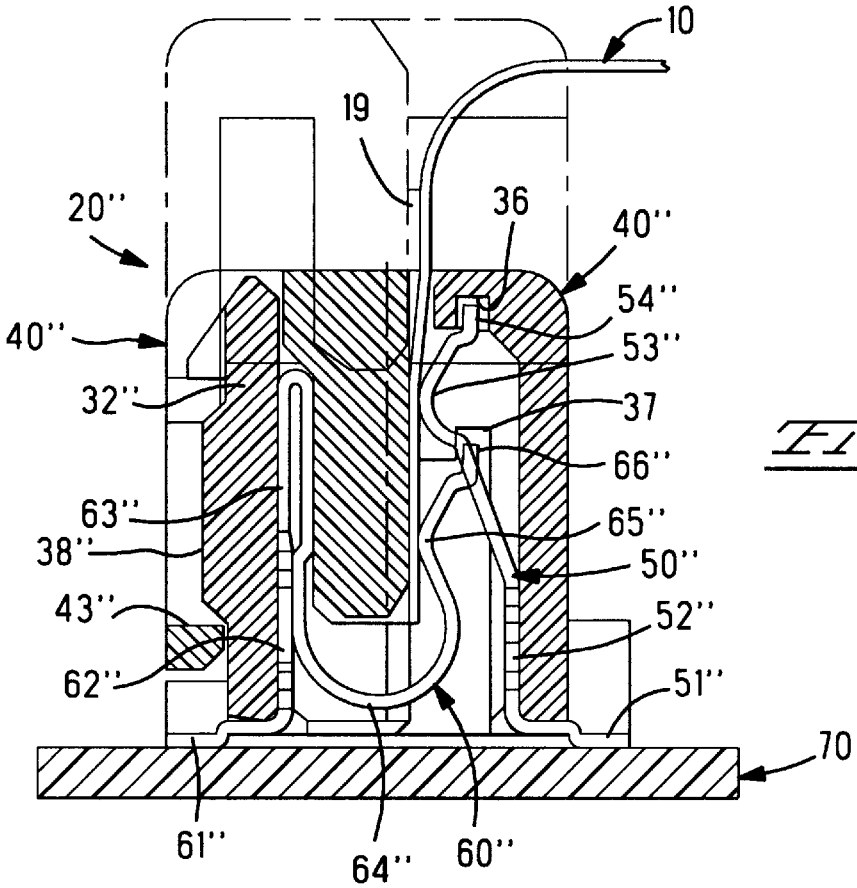
FIG. 6 is a cross-sectional view of the FPC connector shown in FIG. 5.

The connector according to the embodiment of FIGS. 5 and 6 is similar to the FPC connectors 20, 20' shown in FIGS. 2A and 2B and 3A–C in that it has inner housing 30" as well as beam-shaped primary contacts 50" and U-shaped secondary contacts 60". The main difference is the outer housing 40". Outer housing 40" has one side wall 43" and the tongue 45". The use of only one outside wall makes it possible to reduce the overall dimensions of the connector. On the side wall 43" and on the wall of the inner housing 30", matching lugs and notches are provided to latch the outer housing in place on the inner housing.

As can be seen from FIG. 6, the outer housing 40" has only one side wall 43"; and side wall 32" of the inner housing 30" has a lug 38" on its outer surface which fits in a notch 43"*a* in the side wall 43" of the outer housing 40". The lug and notch secure the outer housing 40" on the inner housing 30" in its final position. The free end 54" of the primary contact 50" is retained in recess 36 on the bottom surface of the upper portion of the inner housing 30", and the free end 66" of the secondary contact 60" is retained in recess 37 in the inner housing 30", thus preventing the contacts from deformation caused by an excessive load.

FIG. 6 also depicts the circuit board 70 to which the FPC connector 20" is mounted to connect circuitry on the circuit board 70 and the conductive pads of the FPC 10 inserted in the FPC connector 20". In FIG. 6, the primary contact 50" and the secondary contact 60" are shown as partially overlapping, however it is needless to say that the contacts

50" and 60" are offset in the direction normal to the surface of the drawing. In addition, on the back side of the FPC 10 contacting end, a piece of relatively hard plastic 19 is affixed to facilitate its insertion in the FPC connector 20" which is a common practice with flexible printed cards.

Above, explanations of several embodiments of FPC connectors according to this invention have been provided. However, these embodiments are only examples of the practical implementation of this invention, it is therefore needless to say that they do not limit the scope of this invention. It is possible to introduce various modifications to the beam-shaped primary contacts and U-shaped secondary contacts used in this invention. For example, it is possible to configure the FPC connector for a horizontal mounting on the circuit board.

As follows from the explanations provided above, FPC connectors according to this invention provide for an easy and reliable connection with conductive pads arranged in two rows on the FPC due to the fact that the contact points of the beam-shaped primary contacts and U-shaped secondary contacts can be either shifted or offset in the direction of the FPC insertion. In addition, since both beam-shaped primary contacts and U-shaped secondary contacts have sufficient spring force, highly reliable connections with the FPC conductive pads can be achieved even in small-size FPC connectors. Since the free ends of all contacts are secured either in recesses or openings of the housing, their deformation does not exceed spring limits, thus making it possible to undergo substantial bending without damage during repeated connections and disconnections.

In addition, since in the FPC connector according to this invention the FPC edge is inserted in the U-shaped portion of the secondary contacts together with the tongue of the outer housing or of the slider, a reliable electrical contact can be established even if the points of contact are located close to the bottom of the housing.

I claim:

1. An electrical connector for electrical connection to rows of conductive pads of a flexible printed circuit, comprising:

a housing member having a primary opening;

primary electrical contacts disposed along one wall of the primary opening and having cantilever contact sections extending toward a connection plane and primary contact points provided by the cantilever contact sections located in the connection plane for electrical connection with one of the rows of conductive pads of the flexible printed circuit;

free ends of the cantilever contact sections are disposed in secondary openings in an upper wall of the housing member; and secondary electrical contacts disposed along another wall of the primary opening and having U-shaped sections provided with secondary contact points located in the connection plane for electrical connection to the other of the rows of conductive pads of the flexible printed circuit;

wherein free ends of said secondary electrical contacts are disposed in said primary opening of said dielectric housing.

2. An electrical connector as claimed in claim 1, wherein the primary contact points and the secondary contact points are aligned.

3. An electrical connector as claimed in claim 1, wherein the primary contact points are staggered with respect to the secondary contact points.

4. An electrical connector as claimed in claim 1, wherein an outer housing is movably mounted on said housing member and has a slot coincident with the connection plane, and a tongue that extends along the connection plane along which the conductive pads of the flexible printed circuit extends and which is disposed within the U-shaped sections of said secondary electrical contacts when the outer housing moves from an outer position to an inner position thereby connecting the primary connecting points and the secondary connecting points to the respective rows of conductive pads.

5. An electrical connector as claimed in claim 1, wherein said primary electrical contacts and said secondary electrical contacts have soldering tails for electrical connection with solder pads on a circuit board.

6. An electrical connector as claimed in claim 1, wherein the primary and secondary openings extend through the upper wall.

7. An electrical connector as claimed in claim 1, wherein the primary and secondary openings are recesses.

8. An electrical connector for electrical connection to rows of conductive pads of a flexible printed circuit, comprising:

a housing member having a primary opening;

primary electrical contacts disposed along one wall of the primary opening and having cantilever contact sections extending toward a connection plane and primary contact points provided by the cantilever contact sections located in the connection plane for electrical connection with one of the rows of conductive pads of the flexible printed circuit;

free ends of the cantilever contact sections are disposed in secondary openings in an upper wall of the opening of the housing member;

secondary electrical contacts disposed along another wall of the primary opening and having U-shaped sections provided with secondary contact points located in the connection plane for electrical connection to the other of the rows of conductive pads of the flexible printed circuit; and free ends of the U-shaped sections are disposed in inner recesses within the primary opening of the housing member.

9. An electrical connector as claimed in claim 8, wherein an outer housing is movably mounted on the housing member and has a single wall movable along another wall of the housing member, and a tongue that extends along the connection plane along which the conductive pads of the flexible printed circuit extend and which an inner end of the tongue is disposed within the U-shaped sections of the secondary electrical contacts when the outer housing moves from an outer position to an inner position thereby electrically connecting the primary connecting points and the secondary connecting points to the respective rows of conductive pads.

* * * * *